US007788215B2

(12) United States Patent
Trowbridge et al.

(10) Patent No.: US 7,788,215 B2
(45) Date of Patent: Aug. 31, 2010

(54) AMUSEMENT RIDE WITH RIDER-SELECTED INTEGRATED AUDIO

(75) Inventors: Scott R. Trowbridge, Orlando, FL (US); Steven C. Blum, Orlando, FL (US); Brian McQuillian, Orlando, FL (US); Justin M. Schwartz, Orlando, FL (US)

(73) Assignee: Universal City Studios LLP, Universal City, CA (US)

( * ) Notice: Subject to any disclaimer, the term of this patent is extended or adjusted under 35 U.S.C. 154(b) by 1050 days.

(21) Appl. No.: 11/289,238

(22) Filed: Nov. 29, 2005

(65) Prior Publication Data

US 2007/0121957 A1 May 31, 2007

(51) Int. Cl.
*G06F 17/00* (2006.01)

(52) U.S. Cl. ..... 707/602; 707/607; 707/608; 707/610; 707/826; 707/827

(58) Field of Classification Search ..... 707/600–831
See application file for complete search history.

(56) References Cited

U.S. PATENT DOCUMENTS 4,696,370 A 9/1987 Tokumo et al.
5,784,473 A 7/1998 Ferren
6,060,847 A 5/2000 Hettema
6,224,491 B1 5/2001 Hiromi
2001/0023499 A1 * 9/2001 Wakahara ..... 725/143
2003/0106455 A1 6/2003 Weston
2003/0114178 A1 * 6/2003 Chapelle et al. ..... 455/517

FOREIGN PATENT DOCUMENTS

GB 2282976 A 4/1995
WO 9934344 A 7/1999

* cited by examiner

*Primary Examiner*—Isaac M Woo
(74) *Attorney, Agent, or Firm*—GE Global Patent Operation; Roger C. Phillips; William Fitzpatrick

(57) ABSTRACT

A personalized audio system for an amusement ride includes an audio selection system, a guest identification system and a ride vehicle enabled to reproduce audio selections made using the selection system in a specific seat of the ride vehicle corresponding to the seat occupied by the guest who selected the audio during that guest's ride on the amusement ride.

16 Claims, 3 Drawing Sheets

AMUSEMENT RIDE WITH RIDER-SELECTED INTEGRATED AUDIO

BACKGROUND OF THE INVENTION

The field of the invention relates to amusement or theme park attractions and rides. Various forms of amusement rides have been used for many years in amusement or theme parks. These include traditional rides such as roller coasters, round rides and water rides.

Certain types of amusement rides incorporate themes to entertain guests during the ride. The themes include elements such as visual, audio and sensory elements. For example, amusement rides may have a particular song or musical composition playing over loudspeakers within the vicinity of the amusement ride vehicle. The song or musical composition is heard by all riders on the ride, and possibly by those waiting in line to ride the amusement ride. The musical composition is selected by the ride operator or designer to complement the theme of the amusement ride and add to the guest's experience.

Examples of audio systems for delivering the same audio to all riders in an amusement ride vehicle or attraction include U.S. Pat. No. 5,784,473 which describes an audio system for roller coasters to provide high quality sound over extreme background noise and U.S. Pat. No. 4,696,370 which describes a headrest-mounted acoustic device having a speaker in a hollow of the headrest.

An amusement ride in which a synthesized speech segment corresponding to each guest on the ride based on inputs before the ride is found at Universal Orlando's E.T. amusement ride. Prior to starting the ride, a ride attendant types the name of the guest rider into a speech synthesizer system. The speech synthesizer system generates a bar code for the guest rider which is then swiped at a reader just prior to entering the ride vehicle. At the end of the ride, an animated character containing a speech synthesizer and loudspeaker appears to say each guest rider's name in the ride vehicle as the ride vehicle passes the character. The synthesized speech is not personalized for each rider, as the speech is directed simultaneously at all of the passengers in the ride vehicle.

In all of the prior systems, only a single audio selection is played for all guests on a ride to hear. Accordingly, a need exists for an improved personalized audio system for amusement rides to enhance the overall ride experience.

BRIEF DESCRIPTION OF THE INVENTION

A personalized audio system for a dark ride, high-speed ride, roller coaster or other ride system allows guests to individually select an audio track or song for playback during the ride. The guests enter an audio selection into a selection system associated with an amusement ride they intend to ride prior to being seated in a ride vehicle of the ride. An audio reproduction system reproduces the guests' audio selections for the particular guest occupying a ride vehicle seat. A guest identification system is used to coordinate delivery of the guest's audio selection from the selection system to the correct seat in the ride vehicle. A guest's audio selection is thus delivered to the audio reproduction system for the ride vehicle seat occupied by the guest and then the audio selection is played during the amusement ride operation. The audio reproduction systems are designed so that guest's selections do not interfere with each other.

According to one embodiment of the audio selection system, guests enter their audio selections directly into the selection system using a conventional interface, such as a touch screen or keyboard and mouse. In alternative embodiments, the audio selections are made using wireless devices, such as PDAs or cell phones or in advance using a conventional Internet connection to the selection system. In all embodiments, guests may choose audio selections from a pre-existing library of songs in the selection system, an audio selection from the guest's own storage device, or the guest may even create their own audio selection using the selection system. The guest may permit the selection system to randomly assign an audio selection.

In an embodiment of the identification system, following making an audio selection, guests are then given an identification device for identifying the guest which is correlated with the audio selection. Upon entering the ride vehicle, the guest uses the identification device to coordinate delivery of the correct audio selection to the audio reproduction system associated with the ride vehicle seat. Alternatively, identification systems which rely upon features of the guest, such as biometrics or facial recognition, are used to coordinate delivery of the audio selection to the correct ride vehicle seat.

In a further alternative embodiment of the invention, the guest's audio selection may be complemented by general audio effects generated for all guests during the amusement ride.

The various features of novelty which characterize the invention are pointed out with particularity in the claims annexed to and forming a part of this disclosure. For a better understanding of the invention, its operating advantages and benefits obtained by its uses, reference is made to the accompanying drawings and descriptive matter. The accompanying drawings are intended to show examples of the many forms of the invention. The drawings are not intended as showing the limits of all of the ways the invention can be made and used. Changes to and substitutions of the various components of the invention can of course be made. The invention resides as well in sub-combinations and sub-systems of the elements described, and in methods of using them.

DETAILED DESCRIPTION OF THE INVENTION

Figure 1:
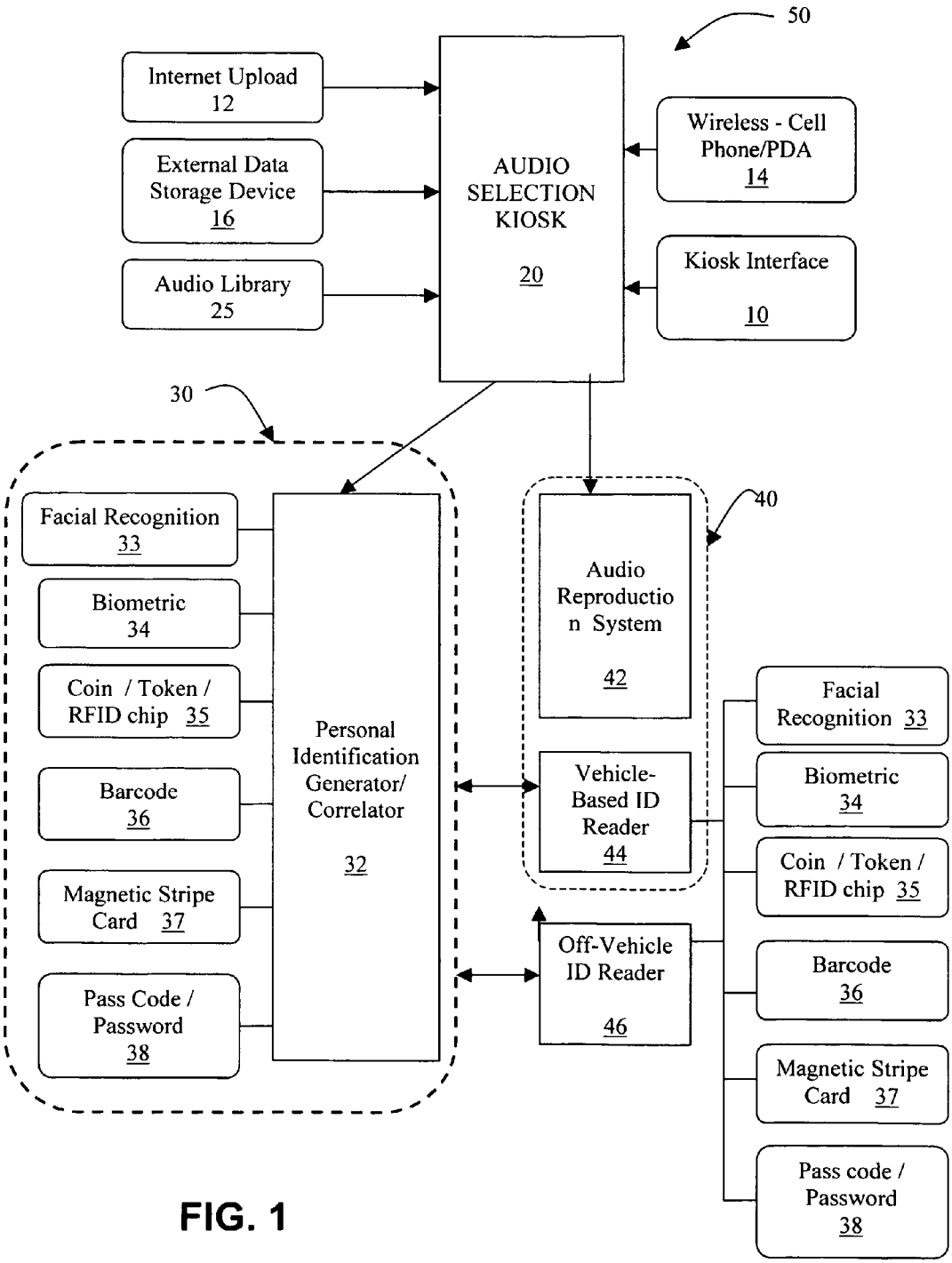
FIG. 1 is a schematic diagram of a personalized audio system for an amusement ride in accordance with one embodiment of the invention.

Referring now to the drawings in which like reference numerals are used to indicate the same or related elements, FIG. 1 illustrates a personalized audio system 50 for an amusement ride having three primary components: an audio selection system 20, a guest identification system 30 and a personal audio reproduction system 42 mounted in each seat of a ride vehicle 40. The personalized audio system 50 permits a guest who rides an amusement ride to pre-select a song, sound or audio theme to play during the guest's turn on the amusement ride that is heard by the guest and which can be different from the audio selection of any other guest on the same amusement ride vehicle 40 during the same run of the ride.

The audio selection system 20 has several available inputs. A guest may identify the audio selection they want to hear during the amusement ride by direction connection with the system, such as by using a kiosk interface 10, via the Internet 12, using a wireless device 14, or by loading an audio selection from an external data storage device 16.

The kiosk interface 10 may comprise one of several stations connected to the same selection system 20, or it can be a single terminal connected to the selection system 20. The kiosk interface 10 is preferably provided with a human interface device such as a keyboard or pointing device and a monitor for providing feedback. The kiosk interface 10 may be operated by a person associated with the system 50 owner, or the guest rider. The kiosk interface 10 is used to choose an audio selection from sources including a connected audio library 25 of pre-determined audio selections for the guest to use, or the guests own external data storage device 16, or even from the Internet 12, if the selection system 20 is connected for Internet access. The selection system 20 in one embodiment includes the necessary ports and connections for attaching external storage devices 16 and other commercially available electronics like MP3 players for loading audio selections into the kiosk 20 that can be played back during the amusement ride. In a still further embodiment, the kiosk interface 10 can be operated by a guest to create a new audio selection from pre-existing segments or samples, or entirely original compositions. The selection system 20 is preferably used by the guest as they wait in line for their turn to ride the amusement ride. The selection system 20 can also be operated by a person associated with the personalized audio system 50 at the direction of the guest via kiosk interface 10 or another available input device.

Alternatively, a guest can use a wireless device 14, such as a cell phone, PDA or portable computer to either upload a music selection from the device 14 or an Internet source 12 or to choose an audio selection from the audio library 25. The wireless device 14 can be used at any time to select the guest's preferred music for a ride, including while waiting in line for the guests' turn or while walking about the amusement park.

In a further embodiment of the personalized audio system 50, the Internet connection 12 is used to pre-select the guest's preferred audio selection for each amusement ride having a personalized audio system 50 from any location, including outside the park. The selection can be made, for example, in advance of a trip to the amusement park. As will be described in more detail below, the guest can obtain an identification for use coordinating the audio selection to the actual ride vehicle seat at the time of the selection over the Internet, or later, at the amusement park.

In each case, after the guest uses the selection system 20 and their preferred input device 10, 12, 14, 16 to make an audio selection, the guest identification system 30 operates to provide a unique identification 33-38 for the guest and associates the identification with the audio selection. The guest identification system 30 can be combined with the selection system 20 as a single unit, or they may comprise separate stations, for example, in a ride queue. The guest identification system 30 includes a personal identification generator 32, which may be embodied as a computer configured to support at least one of the identifications 33-38 and make the association with the audio selection. The personal identification generator 32 uniquely identifies each guest using the selection system 20 via facial recognition 33, biometrics 34, a physical token 35, a barcode 36, a magnetic stripe card 37 or a pass code 38. It is envisioned that other identification systems could be used as well and this list is not intended to be limiting on the scope of the invention. The guest identification system 30 works with a corresponding reader system 44, 46 at the ride vehicle 40 to match the guest's selected audio with their ride vehicle seat.

A facial recognition system 33 can identify the selection system 20 user as the guest is making their audio selection without active participation by the guest, or it can use a posed photograph of the guest taken as the selection is made or subsequent to the selection in order to function. Similarly, a biometric system 34 can detect a guest's fingerprint or retina or other biometric characteristic to identify the guest and associate the audio selection. These two types of identification do not require the guest to retain any physical component or recall any information in order for the system 50 to properly coordinate their audio selection with playback at their ride vehicle seat of choice.

Physical identifiers include a token 35 or other object with an electromagnetic identifier, such as a programmable RFID chip embedded within the token or a series of punches in the token which mechanically identify the guest and their corresponding audio selection. Alternatively, a barcode 36 or magnetic stripe card 37 code can be generated which corresponds to a numeric code that identifies the guest/audio selection. Finally, a pass code system 38 of username/password combinations or simply a unique pass code can be assigned to each guest for correlating the guest to their audio selection. The pass code system 38 can provide printed codes or they can be provided in electronic form, such as when a guest rider uses a wireless device 14 to make their audio selection.

Regardless of the particular identifier 33-38 used to correlate the rider with their audio selection, a corresponding reader 44, 46 is provided on or adjacent the ride vehicle for accepting the identifier 33-38. The rider interacts with the reader 44, 46 to communicate the information from the identifier 33-38 to the guest identification system 30. The reader 44, 46 and guest identification system 30 cooperate to identify the particular seat location within a ride vehicle 40 that will be occupied by the particular guest during the amusement ride. When the guest identification system 30 receives the information from the reader 44, 46, the audio selection system 20 is instructed to deliver the specified guest's audio selection to the audio reproduction system 42.

The reader 44, 46 may be either an on-board system 44 located on the ride vehicle 40, or it can be located near the ride vehicle 40, but connected via a communications link only. In one embodiment of the on-board reader 44, each seat in the ride vehicle 40 has a reader 44 for the particular identifier 33-38 associated with it, so that the seat identification is accomplished by use of the reader 44. For example, each seat location may have a bar code reader 44 for reading a bar code identifier 36 of the guest in the corresponding seat. Alternately, the ride vehicle 40 may have one reader 44 which is used by each guest, such as when facial recognition is used. In such case, the reader 44 and identifier 33 work to identify and determine each guest rider's position within the ride vehicle 40 so that their audio selection is delivered to the correct seat position during the amusement ride operation. In a still further alternative, one reader 44 may be provided on board the ride vehicle 40 having an interface for the rider to input their seat location in the ride vehicle 40 when using their identifier 33-38 with the reader 44 to identify their audio selection.

When the identification reader 46 is positioned off-vehicle, in one embodiment it includes an interface for selecting the seat location of the guest rider, such as when the reader 46 is a bar code reader, RFID reader or biometric sensor. If facial recognition technology is used as the identifier, then the reader 46 may be positioned off-vehicle, but does not require any interface to identify the seat location, as the facial recognition reader 46 can also determine the guest rider's seat position within the ride vehicle 40.

As described above, once the guest rider's identifier 33-38 is used to associate the guest rider with a particular seat, the guest identification system 30 delivers the previously chosen audio selection to the on-board audio reproduction system 42 on the ride vehicle 40. Each seat in the ride vehicle 42 is provided with audio reproduction mechanisms, such as personal loudspeakers mounted in the headrest, restraint system or in a headset worn by the guest rider. The headset can be wired or wireless. An off-board delivery system can be used as well, such as a hypersonic sound system. Once delivered to the audio reproduction system 42, the audio selection can begin playing immediately or upon some other trigger, such as the amusement ride starting to move, or at pre-specified points during the amusement ride.

Figure 2:
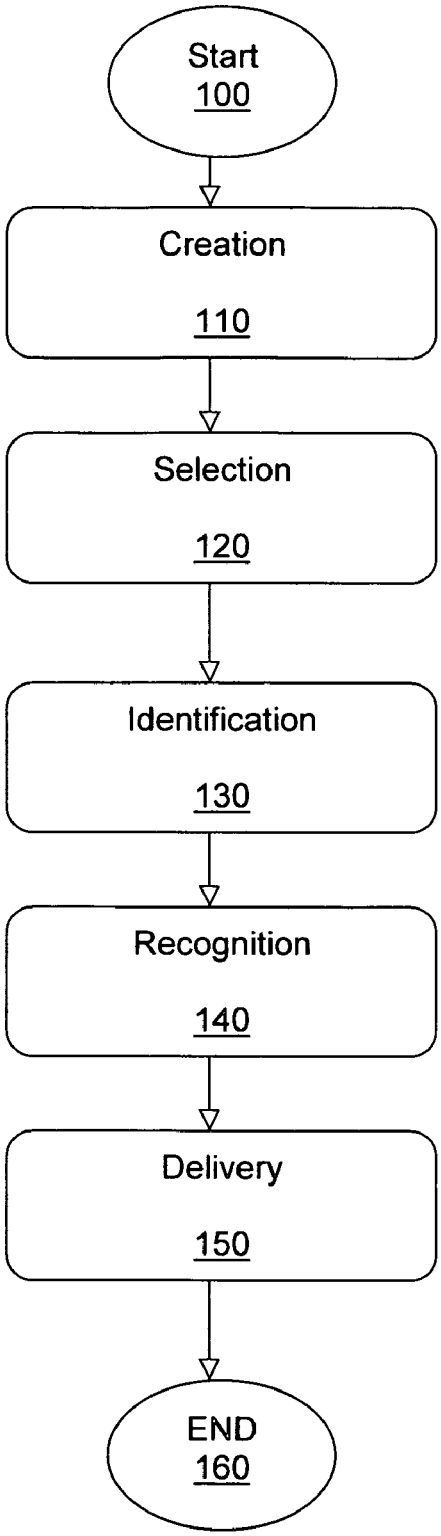
FIG. 2 is a flow chart illustrating the steps in a method for providing personalized audio in an amusement ride.

Referring now to FIG. 2, a method for providing personalized audio to a guest rider is provided. The method includes first initiating 100 the system 50 by accessing the audio selection system 20 using any available input 10, 12, 14, 16 to create 110 an audio selection. As explained above, the audio selection can be taken from a pre-existing library 25, a data storage device 16 or a guest's wireless device 14 or Internet location 12. The selection is added to an audio database of the selection system 20. The audio selections may be created by guest riders or created prior to use by guest riders by operators of the system 50.

Once the system 50 is initiated 100 and at least one audio selection has been created 110, the guest rider selects 120 their desired audio selection from the audio database in the selection system 20 using the available inputs: kiosk interface 10, Internet 12 or wireless device 14. In one embodiment of the selection 120, the guest rider may choose an audio selection from a pre-defined list, such as a top-10 or top-20 list, a musical theme list, or allow the system 50 to randomly assign an audio selection for the rider. In a further embodiment of the selection 120 step, the rider may access an audio selection that was created 110 at a different time by the rider.

Following selection 120 of an audio selection, the guest rider is identified 130 and associated with the audio selection using a unique identifier 33-38. The identifier 33-38 may be any of the above types, including but not limited to facial recognition 33, biometrics 34, a token with RFID or a coded punch card 35, a bar code 36, a card with a magnetic stripe 37 and a pass code 38. The identifier 33-38 is subsequently used by the system 50 in the recognition 140 step to associate the ride vehicle seat chosen by the guest rider with their prior chosen 120 audio selection. The recognition system 30 operates with a reader 44, 46 as described above to recognize 140 and associate the guest rider with a particular seat in the ride vehicle 40.

Once the guest rider has been recognized 140, the guest rider's audio selection is delivered 150 to an audio reproduction system connected with the ride vehicle seat occupied by the guest rider. The audio reproduction system 42 plays the audio selection that the particular guest rider chose for their listening only at the guest rider's seat location at a predetermined trigger point to complete 160 the process.

Figure 3:
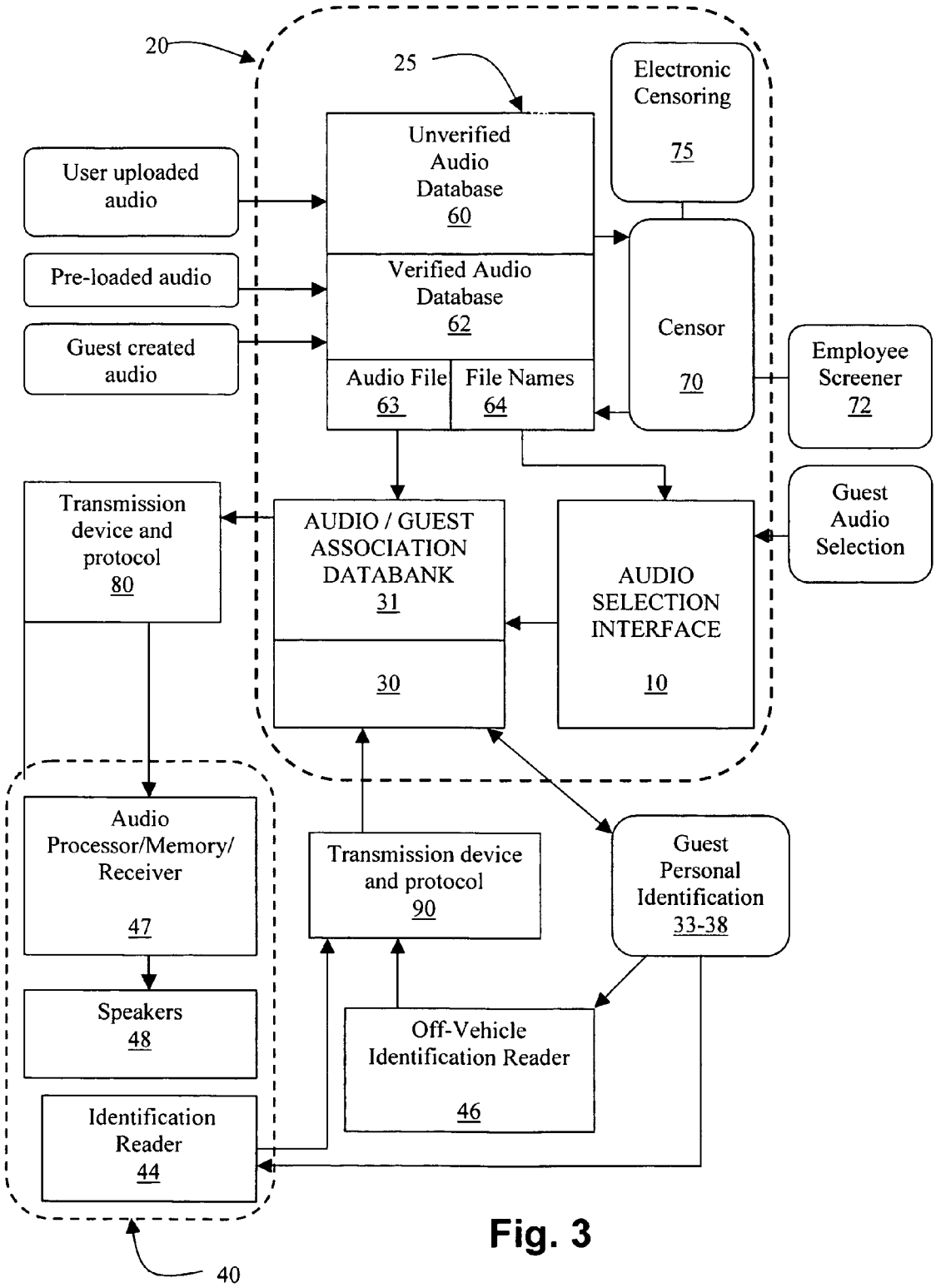
FIG. 3 is a schematic diagram displaying further details for one embodiment of the system of FIG. 1.

Turning now to FIG. 3, one embodiment of the audio selection kiosk 20 is illustrated in conjunction with the other elements of the system 50. The selection system 20 of FIG. 3 includes censoring capability to ensure authorized and/or appropriate audio selections only can be loaded and selected by guest riders. Specifically, the censor 70 operates to determine if audio selections are unauthorized copies of copyright works, or alternately, if the audio selection contains offensive content. The two characteristics—authorized and appropriate content—of the audio selection can both be censored as well if the system 50 operator so desires. The censor 70 can be operated by a human screener 72 or using electronic technology 75, such as file name verification to determine authorized status or acoustic fingerprinting for finding offensive content. In such case, the audio selection of the guest rider is denied and, in one preferred embodiment, the guest is advised of the censor 70 action.

As part of the censoring ability, the selection system 20 includes an audio database of verified audio selection 62, which are known to be authorized and/or non-offensive, depending on the use of the censor 70. The level of offensiveness that is permitted can preferably be set, such as by using a conventional rating system like for movies or video games and television, so that the permitted audio selections are appropriate for the intended guest rider audience. The kiosk also includes a database of audio selections that are not verified 60 and which are being processed for verification and transfer to the verified database 62. The censor 70 and databases 60, 62 can further rely upon stored databases of audio files 63 and file names 64 to more quickly identify audio selections that are authorized by a copyright owner and/or contain appropriate content for the amusement ride.

As further shown in FIG. 3, the guest identification system 30 may be incorporated into the audio selection system 20. The guest identification system 30 includes a databank 31 of associations from guests who have used the system 50. A guest rider who has previously made an audio selection for the amusement ride connected to the system 50 and generated an identifier 33-38 can reuse the identifier 33-38 to have the same audio selection play during subsequent rides on the amusement ride, or a new identifier 33-38 can be generated so that the guest rider can make a new audio selection.

Transmission and protocol devices 80, 90 are provided for communication between the audio reproduction system 40 and the identification readers 44, 46. The transmission and protocol devices 80, 90 can enable wireless or hardwired connections, including bus bars, or a combination of the two communication types. The particular communications protocol used is selected by the operator of the system 50 as well, although any known protocol can be used, including Bluetooth and WiFi among others.

As described herein, the personalized audio system 50 provides an enhanced ride for guest riders on an amusement ride. The system 50 allows an individual guest to select their own audio for a ride to suit the individual's mood, personality or particular preferences. In one embodiment of the system 50, it can be used by guest riders to choose from among pre-determined audio selections containing information about the corresponding amusement ride in different languages, at different educational and/or maturity rating levels. Similarly, in yet another embodiment the system 50 permits a guest to pick audio selections having a particular thematic tone, such as horror, drama, comedy, or a style of music, such as classical, rock, country or new age.

By allowing guest riders to personalize their amusement ride experience by selecting their own preferred audio accompaniment, the guest's overall experience is greatly enhanced and the amusement ride is made more enjoyable. The system 50 provides each guest rider the ability to individually select their preferred audio. The audio selection is delivered to the particular seat the guest rider occupies in the ride vehicle, generally without interference with the audio selections of other guest riders in the same ride vehicle. The audio selection can be delivered to a particular section of a ride vehicle as well, for example, when individual seats are not provided for guest riders, but defined spaces for riding in the ride vehicle are identified.

While the present invention has been described with references to preferred embodiments, various changes or substitutions may be made on these embodiments by those ordinarily skilled in the art pertinent to the present invention with out departing from the technical scope of the present invention. Therefore, the technical scope of the present invention encompasses not only those embodiments described above, but all that fall within the scope of the appended claims.

What is claimed is:

1. A personalized audio system for enhancing an amusement ride experience of a guest rider, comprising:

a seat comprising a seat position supporting a guest;

selection means for choosing an audio selection by the guest rider for selection prior to the guest boarding the amusement ride, assigning an identification parameter with said guest rider;

identification means for associating the audio selection with a guest rider based on said assigned identification parameter;

recognition means cooperating with a ride vehicle of the amusement ride for using the identification means to associate the audio selection with a seat position in the ride vehicle occupied by the guest rider during operation of the amusement ride; and delivery means for transmitting the audio selection into an audio reproduction system and playing back on the audio reproduction system the audio selection chosen by the guest rider only at the seat position occupied by the guest rider during operation of the amusement ride.

2. The personalized audio system of claim 1, wherein the selection means comprises a selection system having user inputs.

3. The personalized audio system of claim 2, wherein the user inputs comprise at least one of an external data storage device, an Internet connection, an audio library, a wireless device and kiosk interface.

4. The personalized audio system of claim 1, wherein the identification means comprises one of facial recognition, biometrics, an RFID chip, a barcode, a magnetic striped card and a password.

5. The personalized audio system of claim 1, wherein the recognition means comprises one of a facial recognition system, a biometric reader, an RFIF scanner, a barcode reader, a magnetic stripe card reader and a password entry device.

6. The personalized audio system of claim 1, wherein the recognition means is located on board the ride vehicle.

7. The personalized audio system of claim 1, wherein the audio reproduction system comprise means for reproducing sound connected with one of loudspeakers, headsets and a hypersonic sound system.

8. The personalized audio system of claim 1, further comprising censoring means for determining whether an audio selection is authorized by a copyright owner.

9. The personalized audio system of claim 1, further comprising censoring means for determining whether an audio selection has content which satisfies a predetermined rating criteria.

10. A method for providing personalized audio to enhance the experience of a guest rider on an amusement ride, comprising:

identifying an audio selection of the guest rider with the guest rider prior to the guest boarding the amusement park ride;

associating an identification parameter with said guest rider;

recognizing the guest rider at the time of the amusement ride based on said associated identification parameter;

associating the audio section with a position within a ride vehicle of the amusement ride occupied by the guest rider during operation of the amusement ride;

delivering the audio selection to an audio reproduction system associated with the position within the ride vehicle, and playing back the audio selection with the audio reproduction system at the position in the ride vehicle for only the guest rider.

11. The method for providing personalized audio according to claim 10, further comprising making an audio selection using an audio selection system.

12. The method for providing personalized audio according to claim 11, wherein making the audio selection comprises loading the audio selection from one of an external storage device, the Internet, a wireless device and an audio library.

13. The method for providing personalized audio according to claim 10, wherein the step of identifying comprises creating an identifier and linking the identifier with a guest.

14. The method for providing personalize audio according to claim 13, wherein creating the identifier comprises on of generating a facial recognition profile, generating a biometric signature, coding an RFIF chip, generating a barcode, generating a magnetic strip card and generating a password.

15. The method for providing personalized audio according to claim 13, wherein the step of associating comprises obtaining information from the identifier and finding the audio selection based on the information.

16. A personalized audio system for enhancing an amusement ride experience of a guest rider, comprising:

a seat comprising a seat position supporting a guest;

selection means for choosing an audio selection by the guest rider;

assigning an identification parameter with said guest rider;

identification means for associating the audio selection with a guest rider based on said assigned identification parameter;

recognition means cooperating with a ride vehicle of the amusement ride for using the identification means to associate the audio selection with the guest rider during operation of the amusement ride; and delivery means for transmitting the audio selection into an audio reproduction system and playing back on the audio reproduction system the audio selection chosen by the guest rider only at the seat position occupied by the guest rider during operation of the amusement ride.

* * * * *